United States Patent [19]

Jupin et al.

[11] Patent Number: 4,809,887

[45] Date of Patent: Mar. 7, 1989

[54] DISTRIBUTOR FOR PASTY PRODUCTS AND A METHOD OF INTRODUCING THE PISTON INTO THE INTERIOR OF THE TUBULAR BODY

[75] Inventors: Alain Jupin; Bernard Schneider, both of Sainte Menehould, France

[73] Assignee: Cebal, Clichy, France

[21] Appl. No.: 116,207

[22] Filed: Nov. 3, 1987

[30] Foreign Application Priority Data

Nov. 3, 1986 [FR] France ..... 86 15443

[51] Int. Cl.[4] ..... B65D 37/00; B65B 7/28

[52] U.S. Cl. ..... 222/207; 222/257; 222/386; 53/489

[58] Field of Search ..... 222/207, 260, 386, 389–391, 222/386.5, 257; 220/93; 53/489

[56] References Cited

U.S. PATENT DOCUMENTS

| | | | |
|---|---|---|---|
| 4,154,371 | 5/1979 | Kolaczinski | 222/212 |
| 4,331,267 | 5/1982 | Duncan et al. | 222/153 |
| 4,402,431 | 9/1983 | Wiegner et al. | 222/207 |
| 4,564,130 | 1/1986 | Eulenburg | 222/207 |
| 4,645,098 | 2/1987 | Hoffmann | 222/386 |
| 4,685,594 | 8/1987 | Czech | 222/182 |

FOREIGN PATENT DOCUMENTS

| | | | |
|---|---|---|---|
| 81145 | 6/1983 | European Pat. Off. | 222/386 |
| 3104726 | 8/1982 | Fed. Rep. of Germany | 222/386 |
| 1070728 | 8/1954 | France | 222/386 |

*Primary Examiner*—Michael S. Huppert

*Attorney, Agent, or Firm*—Dennison, Meserole, Pollack & Pollack

[57] ABSTRACT

A distributor for pasty products comprises a body having a tubular body (4) with a cylindrical barrel (5), a piston (7) with a flexible flared-out top lip (8) sliding in the barrel (5) and a top carrying an orifice through which the pasty product can pass, and also having a distribution head fixed on the tip. Pasty product is directed and expelled by a suction and compression effect. According to the invention, in order to allow air to be evacuated when the piston is being inserted into the tubular body (4), this body (4) comprises a transverse inner relief (35) having a minimal inside diameter which is 0.5 to 1.5 mm less than the inside diameter of the barrel (5) and, preceding it, a flared-out inlet zone (36) having an engagement diameter at least equal to the outside diameter of the flexible lip (8), the outside diameter of the middle part (40) of the piston (7) being at least 0.4 mm smaller than the minimal inside diameter of the relief (35).

10 Claims, 2 Drawing Sheets

DISTRIBUTOR FOR PASTY PRODUCTS AND A METHOD OF INTRODUCING THE PISTON INTO THE INTERIOR OF THE TUBULAR BODY

The invention relates to the field of distributors for pasty products and more particularly those comprising means for directing a pasty product from the interior of a tubular body to a distribution pipe by successive compressions and extractions, the pasty product being conveyed by a flexible lip piston which slides in the barrel of the tubular body. In this case, the term "pasty product" designates any product of a pasty consistency which is capable of being distributed by such a distributor, whether it be classified as a paste, a gel or a thick cream.

THE PRIOR ART

Patent EP-B-No. 0048420 (U.S. Pat. No. 4,402,431) describes a distributor for a pasty product comprising a cylindrical body having at its top a covering surface, and a piston which is applied in fluidtight manner at its circumference against the inside wall of the said cylindrical body following the forward movement of the pasty product in the direction of the covering surface, a forward feed resulting from a negative pressure and atmospheric pressure, and comprising also a diaphragm pump comprising an inlet valve contained in the covering surface, and outlet valve in the distributor and, between the two valves, an elastically compressible pump cavity which is closed except for the valves, the distributor comprising the following desired air leakages and not allowing the pasty product contained in the distributor to pass:

a rough condition on the inner cylindrical wall of the body of the distributor in the region of insertion of the piston, the roughness of the wall then allowing air to escape during insertion of the piston until it is in contact with the pasty product;

an angularly shaped interstice allowing air to pass through it but not the pasty product, between a plug occluding the outlet or distribution orifice of the distributor and an inner edge of this orifice.

The first means requires a particular operation to create the rough surface and the second means implies the use of a tongue or cover incorporating this plug, in addition to the cap which fits over the head of the distributor.

STATEMENT OF THE PROBLEM

The problem of evacuating any air which might otherwise be trapped between the piston and the pasty product while the piston is being placed in position is particularly important, and the Applicants have sought to resolve it in such a way that no particular manufacturing operation is required. The Applicants have likewise sought to resolve the associated problem of evacuating the air present in the container through the distribution orifice without introducing any additional operation or additional component.

STATEMENT OF THE INVENTION

The object of the invention is a distributor for pasty product which, as is known from the document EP-B No. 00 48 420, comprises:

(a) a body comprising a tubular body, a piston sliding in fluidtight fashion inside the circular cylindrical barrel of the tubular body and comprising itself a flexible flared-out top lip sliding within the barrel to ensure fluidtightness, a rigid middle portion which is retracted in relation to the inner surface of the said cylindrical barrel and a semi-rigid flared-out bottom end sliding with a slight clearance or with a slightly forced fit inside the said barrel, and a tip carrying at least one orifice through which the pasty product can pass to the distributor head (b);

(b) a distributor head fixed on the said top of the said body (a) and comprising with the top means for directing the pasty product from within the tubular body to a distribution duct in the said head, by successive extraction and compression movements which result in the said pastry product being expelled towards the said duct;

(c) possibly a cap fixed provisionally on the head (b); the tubular body and possibly the distributor head comprising air leakage means which do not allow the pasty product to pass.

The means of leaking air from the tubular body when the piston is inserted into the body and until it comes in contact with the pasty product contained therein comprise a transverse interior relief situated at the bottom of the said circular cylindrical barrel and of minimal inside diameter, 0.3 to 1.5 mm smaller than the inside diameter of the said barrel, and also a flared-out inlet zone on this relief which has an inside diameter decreasing from an engaging diameter of at least equal to the outside diameter of the flexible lip of the piston in its free state, to the said minimal diameter of the said relief, and the outside diameter of the middle part of the piston is at least 0.4 mm smaller than the said minimal inside diameter of the said relief.

The Applicants have previously observed that with distributors of which the tubular body comprised a cylindrical barrel made from high density polyethylene and which had a diameter of 40 mm and a thickness of 0.8 mm, the problem of evacuating air when the piston was placed in position did not arise. This was undoubtedly due to the relative flexibility of such barrels, and the use of more rigid barrels of 35 mm diameter and of 1 mm thickness led to frequent problems of air being occluded between the piston and the pasty product.

Furthermore, it is known that these problems become more acute in the case of tubular bodies which are of plastics material but which have an interior circular cylindrical surface which is particularly smooth, for example when these tubular bodies are obtained by moulding. In the case of distributors having tubular bodies according to the invention, these bodies each comprising a cylindrical barrel of high density polyethylene, 40 mm in diameter and 1 mm thick, with, at the bottom of the barrel, the transverse interior relief and flared-out inlet zone according to the invention, many dozens of tests have demonstrated that the air included between the flexible lip piston was able to escape satisfactorily.

The flexible flared-out peripheral lip on the piston typically has a profile which in cross-section is referred to as a "knife blade" lip, the root being 0.6 mm thick while close to its extremity, over 1 to 2 mm, the thickness is 0.2 to 0.4 mm, the flared-out lip having an outside diameter at the end which is greater by 0.1 to 0.5 mm than the inside diameter of the circular cylindrical barrel of the tubular body and an angle of inclination which is normally comprised between 10° and 30° in relation to the axis of the piston and of the barrel. This lip is spaced apart from the end disc which constitutes the front of the piston, and is slightly withdrawn from the surface of contact between this disc and the pasty product, so that it is not influenced by such contact.

When the piston is inserted into the flared-out inlet zone, the end of the flexible lip is compelled progressively to retract and a stroboscopic observation performed on several transparent distributor bodies according to the invention, while the pistons are being inserted, has shown that this lip end, after it had negotiated the transverse interior relief which follows on from the inlet zone, had minor undulations or curls and that it retained them until the piston came to a standstill in contact with the pasty product, air passing along these small undulations contributing to prevention of the flexible lip coming to bear against the inside surface of the cylindrical barrel during movement. The undulations in the end of the lip disappear and the lip is applied against the inside surface of the barrel over its entire periphery in a very short time, of around 1 to 2 seconds, after the piston stops in contact with the pasty product. The efficiency with which any air, which might have been trapped had there been no such deformation of the end of the lip, is evacuated has been shown in two ways: there is no piston recoil after stoppage, that is to say no compression and then expansion of occluded air, and emptying of the distributor produces only regular strips of pasty product in which there are no bubbles. If there were no flared-out inlet zone, the end of the flexible lip would abut the transverse interior relief and would tend to fold backwards.

When the piston is introduced too slowly, small undulations on the end of the flexible lip of the piston move aside before the piston stops and when the insertion speed is too high, the problems of guiding the piston become difficult to surmount.

In practice, the speed of travel of the piston should be between 40 and 300 mm/sec and preferably between 80 and 150 mm/sec from the time the flexible lip is inserted into the flared-out inlet zone of the tubular body.

During insertion of the piston, it is important that the rigid middle portion, which is of reduced size, should pass through the transverse inner relief in the tubular body without any friction, so as to cause neither irregularities of feed nor deviations of the piston. For this reason, the outside diameter of this middle part, comprised between the flexible top lip and the semi-rigid flared-out bottom end, is at least 0.4 mm less than the minimal interior diameter of this transverse inner relief.

The semi-rigid flared-out bottom end of the piston, the outside diameter of which at rest is adjusted typically to ±0.2 mm and preferably to ±0.1 mm, in relation to the inside diameter of the circular cylindrical barrel passes without any difficulty through the transverse interior relief, the likely gripping elastic deformation of this flared-out end which is of plastics material and of which the thickness is comprised between 0.6 and 0.8 mm being progressive. After this bottom end of the piston has cleared the transverse relief, it resumes its shape and slides with a minor clearance or with a likely forced action inside the tubular barrel and the transverse relief then prevents any withdrawal of the piston from the tubular body, which gives rise to an anti-fraud security effect and constitutes an important advantage of the invention.

As the flexible lip of the piston typically has an outside diameter greater by 0.1 to 0.5 mm than the inside diameter of the circular cylindrical barrel of the tubular body, it is preferable for the transverse interior relief to choose a minimal inside diameter which is less by 0.4 to 1.2 mm than the inside diameter of the cylindrical barrel. Furthermore, in any case, it is worthwhile having one or a plurality of breaks in the transverse relief, the breaks being of limited length in order not excessively to hamper the formation of the small undulations over the end of the flexible lip, which will in practice be of a unitary length of between 0.5 and 3 mm, these breaks or interruptions permitting of or assisting the evacuation of air, particularly while the semi-rigid flared-out bottom end of the piston is passing through the transverse interior relief.

In practice, for satisfactory monitoring of the deformation of the end of the flexible lip during the retracted condition, it is preferable to have a flared-out inlet zone of the transverse inner relief of the tubular body which is substantially frustconical with a cone half-angle of 10° to 25° in relation to its axis of revolution which is coincident with the longitudinal axis of the circular cylindrical barrel. Furthermore, beyond the minimal interior diameter of the transverse interior relief, an excessively long widening out zone to the inner surface of the cylindrical barrel would have the two-fold drawback of compromising the maintenance of small undulations at the end of the flexible lip until the piston comes to a standstill and of reducing the filling rate of the distributor.

Consequently, it is preferable to have less than 2 mm between the minimal inside diameter zone of the transverse interior relief and the cylindrical inner surface area of the barrel.

The transverse interior relief and the flared-out inlet zone according to the invention may easily be obtained by adding a base portion, of which an interior part, having one zone of minimal inside diameter less by 0.3 to 0.5 mm than the inside diameter of the circular cylindrical barrel, fits at least over a part of its height inside the bottom of the barrel. This inner portion with a minimal interior diameter then normally is of a height comprised between 3 and 12 mm and is preceded by a flared-out inlet zone which likewise forms part of the base.

This added-on base can be fixed to the barrel, for example by adhesion of its socket-shaped part.

The problem of the air leak situated on the distributor head to allow evacuation of any air possibly enclosed within the pasty product while avoiding it drying out and without allowing the pasty product to pass is preferably resolved by using a small rib having a typical height of 0.05 to 0.15 mm carried on the end face of the circumference of the outlet orifice of the distributor duct in the head, this flat or convex end surface being complementary to the corresponding inner surface of the cap. This solution is simple and requires no additional component: as the cap fits in fluidtight manner on the head and its distribution orifice, for example with a simple forced fit, or a click stop or screwed fitment, the addition of this small relief does not interfere with this fitment and provides the small leakage required.

The invention is applied in particular to a new type of distributor, used for test purposes, a brief description of which will be given with reference to these tests. This distributor is described in greater detail in our French Patent Application No. 86-14348 of Oct. 13, 1986.

The distributor body according to the invention may be of one or a plurality of materials, including particularly high density polyethylene, polypropylene, thermoplastics polymers, glass, metal such as aluminium, and in the case of the cylindrical barrel the metalloplastic complexes are feasible. The tubular body is in a single piece or has an added-on base, its transverse inner relief and its flared-out inlet zone being obtained by moulding, forming or by the addition of a base. The outside diameter of its cylindrical barrel is typically comprised between 20 and 50 mm.

Finally, the invention has as object the appropriate method of inserting the piston into the interior of the tubular body, in which:

(A) the piston is lowered towards the pasty product, the flexible lip in the front, axial guidance being provided during the course of this downwards movement;

(B) contact is established between the end of the flexible lip inside a flared-out inlet zone in the tubular body, the diameter of which then decreases continuously until it reaches the minimal inside diameter of a transverse relief, the said minimal diameter being 0.3 to 1.5 mm less than the inside diameter of the barrel, the end of the flexible lip being retracted by making it negotiate the inlet zone and this transverse relief;

(C) displacement of the piston is continued by causing it completely to cross through the inlet zone and the transverse relief and until it makes contact with the pasty product; the rate of travel of the piston during stages (B) and (C) being comprised between 40 and 300 mm/sec and preferably between 80 and 150 mm/sec.

For this method, the following arrangements are preferably made:

the outside diameter of the flexible lip is 0.2 to 0.4 mm greater than the inside diameter of the circular cylindrical barrel;

the flared-out inlet zone of the tubular body is substantially frustoconical with a cone half-angle comprised between 10° and 25°;

the cylindrical inner surface of the barrel begins less than 2 mm after the zone of minimal inside diameter of the transverse relief of the tubular body.

The description of the tests and examples will make it possible more clearly to understand the various aspects of the invention.

TESTS AND EXAMPLES

Figure 1:
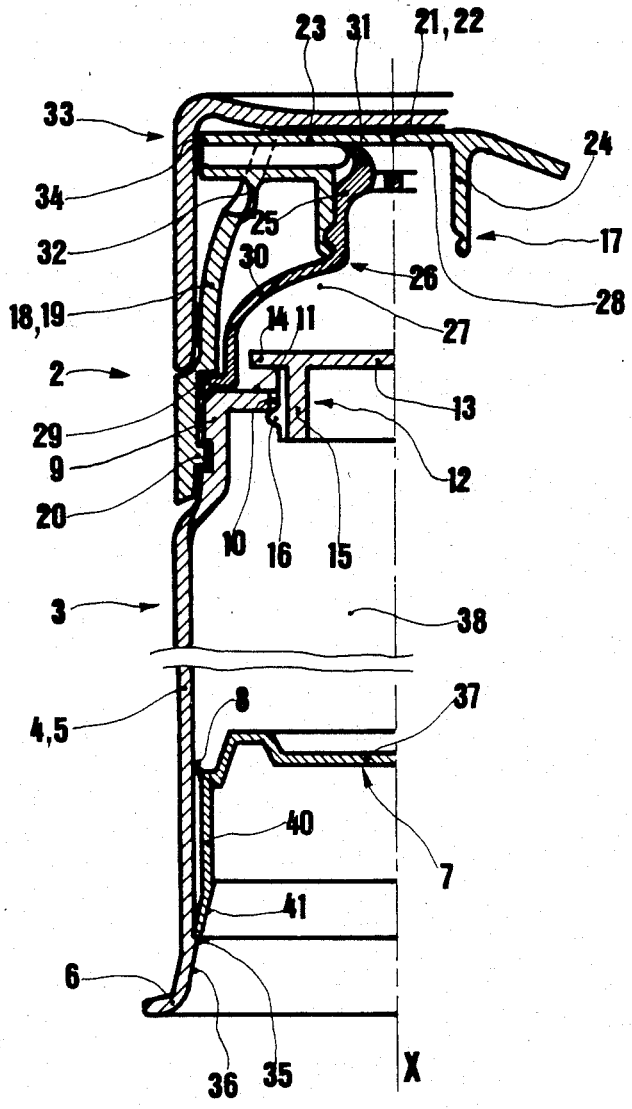
FIG. 1 shows a first distributor according to the invention, used for tests, in longitudinal cross-section.
Figure 2:
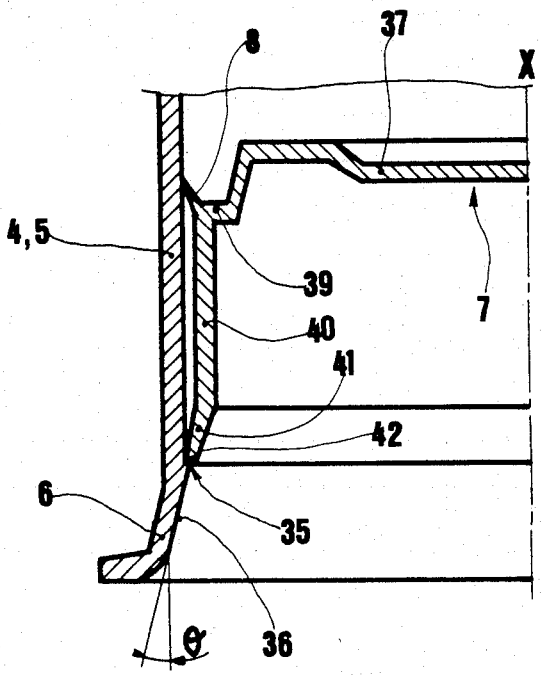
FIG. 2 shows the bottom of the tubular body and the piston of this first distributor, on an enlarged scale, likewise in longitudinal section.

Comparative tests relative to the insertion of the piston into the tubular body of the distributor when it is filled with pasty product, that is to say toothpaste, were carried out using distributors of the type shown in FIG. 1, some with no transverse inner relief according to the present invention, the others with a transverse inner relief and the flared-out inlet zone, as shown in FIGS. 1 and 2.

This distributor 1 (FIG. 1) comprises a distributor head 2 and a body 3, the said body 3 comprising on the one hand a tubular body 4 which comprises a circular cylindrical barrel 5 and a base 6, and on the other a sliding piston 7 having a flexible flared-out top lip 8 sliding inside the barrel 5 to ensure fluid-tightness, and finally a tip 9, in this case surmounted on the extruded barrel 5 and itself comprising a central orifice 10 surrounded by an annular bearing surface 11 constituting the seating of an inlet valve 11, 12 of pasty product, of which the valve 12 comprises an upper web 13, the annular edge 14 of which ensures occlusion of the orifice 10 by being applied against the surface 11, and a subjacent portion 15 engaged into the said orifice 10 and provided with retaining bosses 16 having a circumscribed cylinder diameter greater by 1 to 2 mm than the diameter of the orifice 10, and force-fitted through this orifice 10.

The distributor head 2 comprises:

an actuator 17 which comprises on the one hand a fixed portion 18 incorporating an outer jacket 19 carrying at its bottom end a means 20 for attachment onto the top 9 of the body 3 of the distributor 1 and on the other an inclinable central part 21 connected to its fixed part 18 by a deformable lug 32 and comprising a bearing web 22 and a distribution duct 23 discharging into a longitudinal channel 24 carried by the bottom of the bearing web 22 and which fits in fluidtight fashion over the upper tube 25 of a deformable dish-shaped member 26 which, with the bearing web 22 and with the top 9 of the body 3 of the distributor, forms a compression chamber 27, the bottom surface 28 of the bearing web 22 at the bottom of this channel 24 being flat or slightly curved;

the deformable dish-shaped member 26 which is in a single piece and comprises, from the bottom upwards: a means 29 for fluidtight fitment on the tip 2 of the body 3 of the distributor and then a deformable web 30 followed by the top tube 25 surmounted by a flexible top lip 31 which, with the bottom surface 28 of the bearing web 22, forms in the bottom of the channel 24 an expulsion valve 28, 31 for passing product into the distribution duct 23.

The removable cap 33 is simply pushed over the distributor head 2, gripping on the outer barrel 19 and bearing on the end 34 of the distribution duct 23. The tubular body 4 of the body 4 comprises (FIGS. 1 and 2) at the bottom of its circular cylindrical barrel 5 a transverse inner relief 35 preceded by a flared-out inlet zone 36. The minimal inside diameter of the relief 35 is 32.2 mm while the inside diameter of the barrel 5 which has an outside diameter of 35 mm and a thickness of 1 mm is 33 mm. The flared-out inlet zone 36 is a frustum of revolution about the axis X of the barrel 5, with a cone half-angle $\theta$ of 15° (FIG. 2), the height of this frustoconical zone being 4 mm while its diameter of engagement is 34 mm. The piston 7 has a total height of 15 mm and is of high density polyethylene, comprising in front an end disc 37 which is 0.8 mm thick, and which is crimped in such a way as to reduce to the best advantage the residual volume of the storage chamber 38 comprised between the disc 37 and the top 9 of the body 3 of the distributor (FIG. 1) upon completion of guidance and then (FIG. 2) is smaller by 1.5 to 2 mm and is separated from this disc 37 by a hollow annular portion 39, the flexible top lip 8 having at the end an outside diameter (at rest) of 33.3 mm, then a cylindrical middle portion 40 having an outside diameter of 31.5 mm and a thickness of 1 mm and a height of 8 mm, and finally extending this middle portion 40 by a slightly flared-out and slightly thinner bottom end 41, of which the actual end 42 has at rest an outside diameter of 33.1 mm and a thickness of 0.6 to 0.7 mm. Once the piston 7 has been fully introduced into the interior of the barrel 5, the transverse relief 35 prevents withdrawing the bottom end 42. 41 in order to extract the piston 7 from the tubular body 4.

TESTS CONDUCTED ON SUCH DISTRIBUTORS

The distributors were filled with toothpaste, upside down as is normal, up to 18 to 20 mm from the bottom end of the cylindrical barrel 5, that is to say substantially at the same distance below the zone of minimum diameter 32.2 mm of the transverse relief 35 which ends somewhat abruptly, less than 1 mm from the side of the barrel 5. Then, insertions of pistons 7 were carried out by means of an apparatus of the cork-inserting type, ensuring correct guidance and manually controlled introduction by a lever action. The speeds of insertion achieved were between 60 and 80 mm/sec.

Thirty distributors of a first group comprised a transverse relief 35 which was interrupted, and 15 additional distributors comprised a similar relief 35 with a break approx. 2 mm in length and with a bottom diameter close to the inside diameter of the barrel 5, prepared in a re-run.

Tests to introduce pistons until they make contact with the pasty product yielded the following results:

among the thirty distributors in the first group, six showed a slight tendency to lift the piston (less than 1 mm) and there were some inclusions of air in the toothpaste when the distributor was finally emptied, whereas the other twenty-four distributors presented no problem;

the stroboscopic observation already described in the statement of the invention was carried out on five of these distributors, their tubular bodies being sufficiently transparent. In addition, four distributors of the same type were sectioned transversely beyond their circular transverse relief, the piston in each distributor being stopped in the position where the end of the flexible lip is just negotiating this relief, and it was observed that in each of these cases, and over a little more than 1 mm from its end, this lip formed 12 to 15 long transverse undulations over its periphery.

the other fifteen distributors all gave excellent results. The craftsmanlike nature of these tests makes it possible to deduce that, on an industrial scale, one or more breaks in the transverse interior relief are not required in all embodiments while for other cases and generally speaking they do offer a satisfactory degree of security that the required evacuation of air will be performed.

EMBODIMENT OF TRANSVERSE INNER RELIEF WITH AN ADDED-ON BASE

Figure 3:
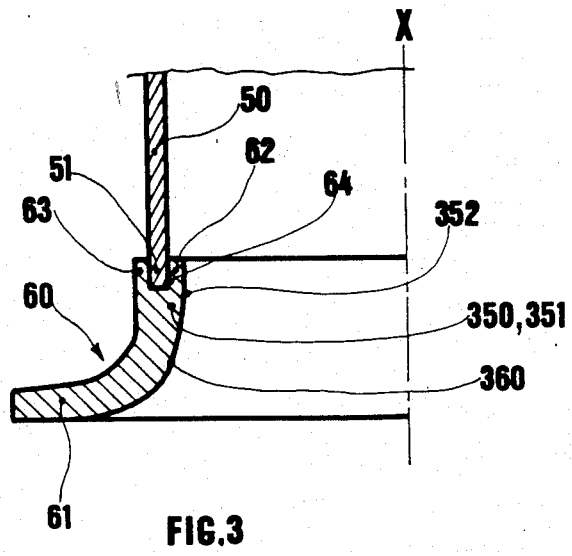
FIG. 3 shows the bottom of the tubular body and the added-on base of a second distributor according to the invention, in longitudinal section.

FIG. 3 shows a moulded base 60 comprising a widened bearing part 61 and two circular top lips, an inner lip 62 and an outer lip 63, each 0.5 mm thick and 4 mm high, leaving between them a circular groove 64 into which fits the bottom end 51 of the circular cylindrical barrel 50 of the tubular body. The inside diameter of the barrel 50, which is 1 mm thick, is 33 mm as previously and the inside part 351 of the base 60, the inner lip 62 of which fits into the end 51 of the barrel 50, constitutes a transverse inner relief 350, of which the zone of minimal inside diameter 352 is 8 mm high. This zone 352 is preceded by a flared-out and slightly incurvate inlet zone 360 inclined at 15° to 20° in its part which engages the flexible lip of the piston, which is in the same as in the preceding example and tests. This moulded base 60 is of polypropylene and the end 51 of the barrel 50 is fixed into its double lip 62, 63 by gluing.

EXAMPLE OF AN AIR LEAKAGE MEANS CARRIED BY THE DISTRIBUTION DUCT

Figure 4:
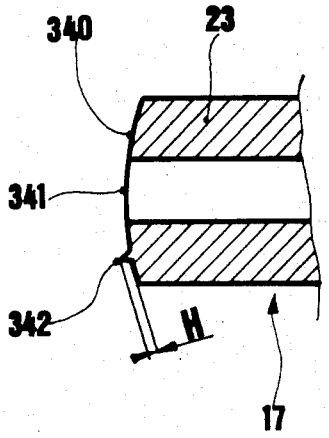
FIG. 4 shows the circumference of the distribution orifice in a distributor according to the invention, in partial cross-section through a fine rib which creates a leakage of air.

FIG. 4 shows a partial horizontal section through the distribution duct 23 of an actuator 17 (FIG. 1). The cap 33 of the distributor comprises an inclined part which bears on the end face 340 of the duct 23, matching the corresponding inner surface of the cap. This end surface 340 around the orifice 341 comprises a small and in this case substantially vertical rib 342 projecting from this surface by a height H of 0.1 mm and having a length of approx. 1 mm. This small relief is sufficient for the bearing of the cap on the end of the duct not to be perfect and therefore airtight, while it is nonetheless impervious to the pasty product being distributed. Therefore, evacuation of air from the pasty product when the cap is closed is correctly performed from its distribution side.

APPLICATIONS

The distributor according to the invention which is rendered inviolable by virtue of its transverse inner relief, is used typically for the packaging and distribution of hygiene and cosmetic products in the form of pastes or gels, particularly of toothpastes, and for food products in the form of pastes or thick creams, for example condiments and toppings.

We claim:

1. Distributor for pasty products, comprising:

(a) a body (3) comprising a tubular body (4), a piston (7) sliding in fluidtight fashion in the inside of a circular cylindrical barrel (5) of the tubular body (4), said piston comprising a flexible flared-out top lip (8) sliding within the barrel (5) to ensure fluidtightness, a rigid middle portion (40) which is retracted in relation to the inner surface of the said cylindrical barrel (5) and a semi-rigid flared-out bottom end (41) sliding with a slight clearance or with a slightly forced fit inside said barrel (5), and said body also comprising a top (9) carrying at least one orifice (341) through which the pasty product can pass to a distributor head (b); and (b) a distributor head (2) fixed on said top (9) of said body (3) and comprising with the top (9) means (10 and 12, 26, 28 and 31) for directing the pasty product from within the tubular body (4) to a distribution duct (23) in said head (2), by movements providing successive extraction and compression of the pasty product so that said pasty product is expelled towards said duct (23);

the tubular body (4) comprising air leakage means (35, 342) which do not allow the pasty product to pass, the means leaking air from the tubular body (4) when the piston (7) is inserted into the body (4) and until it comes in contact with the pasty product contained therein and comprising an interior relief (35, 350) transverse to the axis of the cylindrical barrel (5, 50) and situated at the bottom of the said barrel (5, 50) and of minimal inside diameter, 0.3 to 1.5 mm smaller than the inside diameter of said barrel (5, 50) and also a flared-out inlet zone (36, 360) before this relief (35, 350) which has an inside diameter decreasing from an engaging diameter at least equal to the outside diameter of the flexible lip (8) of the piston (7) in its free state, to said minimal diameter of said relief (35, 350), the outside diameter of the middle part (40) of the piston (7) being at least 0.4 mm smaller than said minimal inside diameter of said relief (35, 350).

2. Distributor according to claim 1, wherein the outside diameter of the said flexible lip (8) of the piston (7) is by 0.1 to 0.5 mm greater than the inside diameter of said circular cylindrical barrel (5, 50) of the tubular body (4), the said transverse inner relief (35, 350) having a minimal inside diameter which is 0.4 to 1.2 mm smaller than the inside diameter of said barrel (5, 50).

3. Distributor according to claim 1, wherein said transverse interior relief (35) comprises at least one break of length between 0.5 and 3 mm.

4. Distributor according to claim 1 or 2, wherein an inlet zone (36, 360) of said transverse inner relief (35, 350) is substantially frustoconical with a cone half-angle of 10° to 25°, its axis X being the axis X of the circular cylindrical barrel (5, 50) and the zone of minimal interior diameter (35, 351) of said inner relief (35, 350) being situated at least 2 mm from the cylindrical inner surface of said barrel (5, 50).

5. Distributor according to claim 1, wherein the transverse inner relief (350) consists of an inner portion (351, 62) of an added-on base (60), said portion (351, 62) fitting into bottom (51) of the said circular cylindrical barrel (50).

6. Distributor according to claim 1, additionally comprising a cap fitted over the distributing head (2), wherein said distributing head (2) comprises air leakage means through which air can escape after fitment of the cap (33) and consisting of a small rib (342) 0.05 to 0.15 mm high, carried by the end surface (340) in the circumference of the distribution orifice (341) of the head (2), said end surface (340) being flat or convex and matching the corresponding inner surface of the cap (33).

7. Distributor according to claim 1, wherein:

(a) the top (9) of the body (3) carries an orifice (10) and an inlet valve (11 and 12) for the introduction of pasty product, the valve including a seat being an annular surface (11) surrounding said orifice (10) and a flap member (12) constituted by an occluding web (13), having a annular edge (14) applied in fluidtight manner on said annular surface (11) in a position of closure of the valve (11 and 12), and a subjacent portion (15) engaged in said orifice (10) and provided in its bottom part with retaining bosses (16), the diameter of the cylinder circumscribed at these bosses (16) being greater by 1 to 2 mm than the diameter of the said orifice (10);

(b) the distribution head (2) comprises:

an actuator (17) comprising a fixed part (18) comprising an outer barrel (19) carrying in its bottom part a means (20) for attachment to the top (9) of the body (3) of the distributor (1), and an inclinable central part (21) connected to the fixed part (18) and comprising a bearing web (22) and the distribution duct (23) discharging into a longitudinal channel (24) which is carried by the bottom of the said bearing web (22), a deformable dish-shaped member (26) having an upper tube (25) over which said duct (23) fits in fluidtight fashion, which member (26) forms a compression chamber (27) together with said bearing web (22) and said top (9) of the body (3) of the distributor (1), the bottom surface (28) of said bearing web (22) at the bottom of said channel (24) being flat or slightly curved;

said deformable dish-shaped member (26) is in a single piece and comprises, from the bottom upwardly:

a means (29) for fluidtight fitment on the top (9) of the body (3) of the distributor (1), then a deformable web (30), then said upper tube (25) surmounted by a flexible top lip (31) which forms with said bottom surface (28) of the bearing web (22) in the bottom of said channel (24) a valve (28 and 31) for expulsion of product into said distribution duct (23).

8. A method of inserting a piston (7) into a circular cylindrical barrel interior of a tubular body (4) of a distributor (1) containing pasty product, said piston (7) comprising a flexible flared-out top lip (8) of plastics material and having an outside diameter greater by 0.1 to 0.5 mm than the inside diameter of the circular cylindrical barrel (5, 50) of said tubular body (4) and sliding in fluidtight fashion within said barrel (5, 50), comprising:

(A) lowering the piston (7) towards the pasty product, said flexible lip (8) being towards the front, ensuring its axial guidance during the course of this downwards movement;

(B) brining the end of the flexible lip (8) into contact with the interior of a flared-out inlet zone (36, 360) in the tubular body (4), of which the diameter then decreases continuously down to a minimum inside diameter of a transverse relief (35, 350), said minimal diameter being less by 0.3 to 1.5 mm than the inside diameter of said barrel (5, 50), the end of the flexible lip (8) being pulled in, causing it to pass over this inlet zone (36, 360) and this transverse relief (35, 350);

(C) continuing movement of the piston (7), causing it to cross said inlet zone (36, 360) completely and also said transverse relief (35, 350) until it comes in contact with the pasty product;

wherein the speed of displacement of the piston (7) during the stages (B) and (C) is between 40 and 300 mm/sec.

9. Method according to claim 8, wherein the speed of travel of the piston (7) having the flexible lip (8) is, for stages (B) and (C) between 80 and 150 mm/sec.

10. Method according to claim 9, wherein:

the outside diameter of the flexible lip (8) is 0.2 to 0.4 mm larger than the inside diameter of the circular cylindrical barrel (5, 50);

the flared-out inlet zone (36) of the tubular body is substantially frustoconical with a cone half-angle $\theta$ between 10° and 25°;

the cylindrical inner surface of the barrel (5, 50) is regained, less 2 mm, after the zone of minimal inside diameter (35, 352) of the transverse relief (35, 350) of the tubular body (4).

* * * * *